US010557470B2

(12) United States Patent
Pagliarin

(10) Patent No.: US 10,557,470 B2
(45) Date of Patent: Feb. 11, 2020

(54) AIR COMPRESSOR PROVIDED WITH BELT GUARD

(71) Applicant: ABAC ARIA COMPRESSA S.p.A., Robassomero, Turin (IT)

(72) Inventor: Alessandro Pagliarin, Turin (IT)

(73) Assignee: ABAC ARIA COMPRESSA S.p.A., Robassomero, Turin (IT)

( * ) Notice: Subject to any disclaimer, the term of this patent is extended or adjusted under 35 U.S.C. 154(b) by 114 days.

(21) Appl. No.: 14/367,729

(22) PCT Filed: Dec. 21, 2012

(86) PCT No.: PCT/IB2012/057615
§ 371 (c)(1),
(2) Date: Jun. 20, 2014

(87) PCT Pub. No.: WO2013/098742
PCT Pub. Date: Jul. 4, 2013

(65) Prior Publication Data

US 2014/0348671 A1 Nov. 27, 2014

(30) Foreign Application Priority Data

Dec. 27, 2011 (IT) ..... TO2011A1214

(51) Int. Cl.
*F04D 25/02* (2006.01)
*F04B 39/06* (2006.01)
(Continued)

(52) U.S. Cl.
CPC ..... *F04D 25/02* (2013.01); *F04B 39/06* (2013.01); *F04B 39/12* (2013.01); *F04B 17/03* (2013.01); *F04B 17/06* (2013.01)

(58) Field of Classification Search
CPC ..... F04B 35/04; F04B 39/066; F04B 35/06; F04B 39/06; F04B 39/12; F04B 41/02;
(Continued)

(56) References Cited

U.S. PATENT DOCUMENTS 4,077,747 A * 3/1978 Burenga ..... F04B 41/02 417/234
4,801,250 A * 1/1989 Lammers ..... F04B 39/066 137/851
(Continued)

FOREIGN PATENT DOCUMENTS

DE 14 26 743 A1 11/1968
JP 6-129383 A 5/1994
(Continued)

OTHER PUBLICATIONS

International Search Report for corresponding International Patent Application No. PCT/IB2012/057615 dated Oct. 30, 2013.

*Primary Examiner* — Philip E Stimpert
(74) *Attorney, Agent, or Firm* — Merchant & Gould P.C.

(57) ABSTRACT

An air compressor (10) has a reservoir (12), pump (14), motor (16), transmission belt (18) wound around a driving pulley (20) coupled to a motor shaft (16) and around a driven pulley (22) coupled to a pump shaft. Driven pulley spokes (28) are shaped as fan blades transmit torque and cool the pump (14). A belt guard (30) encloses the transmission belt (18), and pulleys (20, 22). The belt guard (18) has a front wall (32) with slits (34) for air drawn by the driven pulley (22), a side wall (36) enclosing the space around the transmission belt (18) and around pulleys (20, 22), and a rear wall (38) having an opening (40) receiving the pump (14). Air drawn through the slits (34) in the front wall (32) passes towards the pump (14). The guard rear wall (38) covers the pump (14) by at least 30% of its depth.

7 Claims, 4 Drawing Sheets

(51) Int. Cl.
*F04B 39/12* (2006.01)
*F04B 17/03* (2006.01)
*F04B 17/06* (2006.01)

(58) Field of Classification Search
CPC ..... F04B 41/06; F04B 17/03; F04B 17/06; F04D 25/02; F04D 25/166; F04D 25/08; F04D 25/16; F04D 25/163
USPC ..... 417/234
See application file for complete search history.

(56) References Cited

U.S. PATENT DOCUMENTS

| | | | | |
|---|---|---|---|---|
| 6,406,270 | B1 * | 6/2002 | Kopel | F04B 35/002 417/234 |
| 6,930,882 | B2 * | 8/2005 | Broder | G06F 1/20 165/104.33 |
| 2005/0002801 | A1 | 1/2005 | Chen | |
| 2009/0110567 | A1 * | 4/2009 | Averill | F04B 27/053 417/243 |

FOREIGN PATENT DOCUMENTS

| | | | |
|---|---|---|---|
| JP | 8-270565 | A | 10/1996 |
| JP | 2005-139977 | A | 6/2005 |
| JP | 2006-220123 | A | 8/2006 |

* cited by examiner

AIR COMPRESSOR PROVIDED WITH BELT GUARD

This application is a National Stage Application of PCT/IB2012/057615, filed 21 Dec. 2012, which claims benefit of Serial No. TO2011A001214, filed 27 Dec. 2011 in Italy and which applications are incorporated herein by reference, To the extent appropriate, a claim of priority is made to each of the above disclosed applications.

BACKGROUND OF THE INVENTION

The present invention relates to an air compressor.

Air compressors are known which basically comprise a reservoir intended to contain compressed air, a pump unit for producing compressed air to be fed to the reservoir, and an electric motor for driving the pump unit by means of a transmission belt. The transmission belt serves to transmit driving torque from a driving pulley torsionally coupled to a shaft of the electric motor to a driven pulley torsionally coupled to a drive shaft of the pump unit, the shafts of the electric motor and of the pump unit being oriented parallel to each other. The driven pulley is typically shaped as a fan, in that the spokes of the pulley connecting the hub of the pulley, which is mounted on the drive shaft of the pump unit, to the ring of the pulley, around which the transmission belt is wound, are shaped as fan blades. The driven pulley thus performs not only the function of transmitting torque to the drive shaft of the pump unit, but also the function of cooling the pump unit itself. Such known compressors further comprise a belt guard which encloses the transmission belt, as well as the driving and driven pulleys, so as to avoid the risk that the user or any other person inadvertently touches these components of the compressor. The belt guard may be made of metal wire to form a grid-like structure or of plastic material to form a suitably shaped cover having a number of slits through which air is drawn from outside by the spokes of the driven pulley made as fan blades. The pulley/fan has a quite reduced capacity of cooling the pump unit. There is therefore the problem, in the known compressors of the above-described type, to avoid excessive heating of the pump unit.

SUMMARY OF THE INVENTION

It is therefore an object of the present invention to provide an air compressor of the above-specified type, which is not affected by the drawback of the prior art discussed above, and which allows therefore to cool the pump unit more efficiently.

Further advantageous features of the invention are set forth in the dependent claims, the content of which is to be regarded as being an integral and integrating part of the following description.

In short, the invention is based on the idea of using a belt guard which is made as a cover, preferably of plastic material, and comprises a front wall, in which slits are provided for allowing air drawn from outside by the spokes of the driven pulley acting as fan blades to flow therethrough, a side wall which encloses laterally the space around the belt and around the driving and driven pulleys, and a rear wall which closes on the rear side the space around the belt and around the driving and driven pulleys and which has an opening for receiving the pump unit, in such a manner that air drawn from outside through the slits provided in the front wall of the belt guard is conveyed towards the pump unit, the rear wall of the belt guard being shaped so as to cover the pump unit by at least 30% of the depth of the pump unit itself, the depth of the pump unit meaning the size of that unit along the direction of the axis of the respective drive shaft.

BRIEF DESCRIPTION OF THE DRAWINGS

Further features and advantages of the invention will become clear from the following detailed description, given purely by way of non-limiting example with reference to the appended drawings, in which.

DETAILED DESCRIPTION OF THE PREFERREDEMBODIMENT

Figure 1:
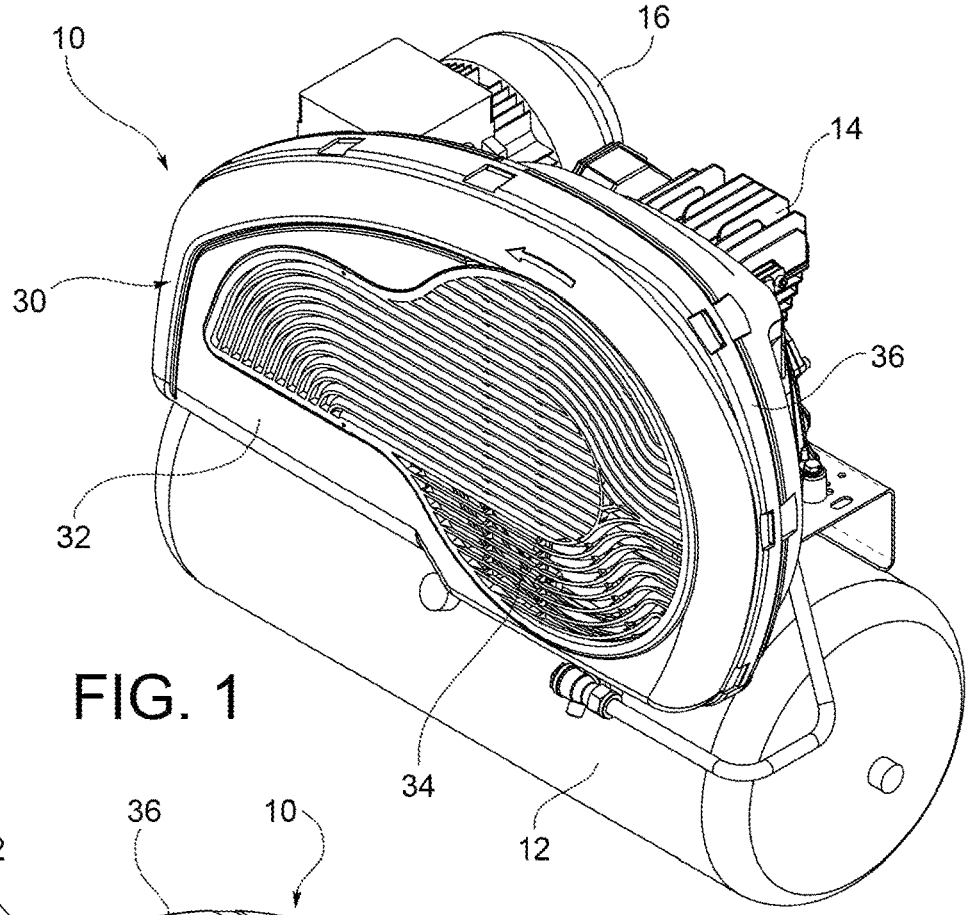
FIGS. 1 and 2 are perspective views, from the front side and from the rear side, respectively, of an air compressor according to a preferred embodiment of the present invention.
Figure 2:
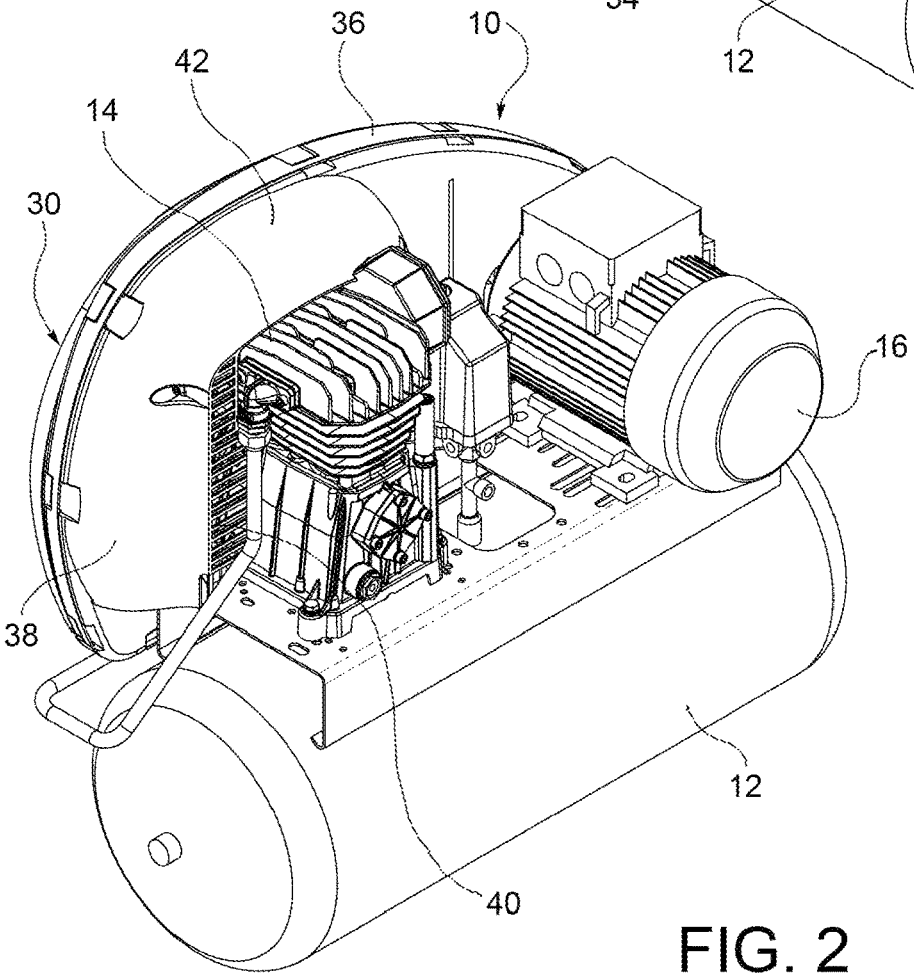
Figure 3:
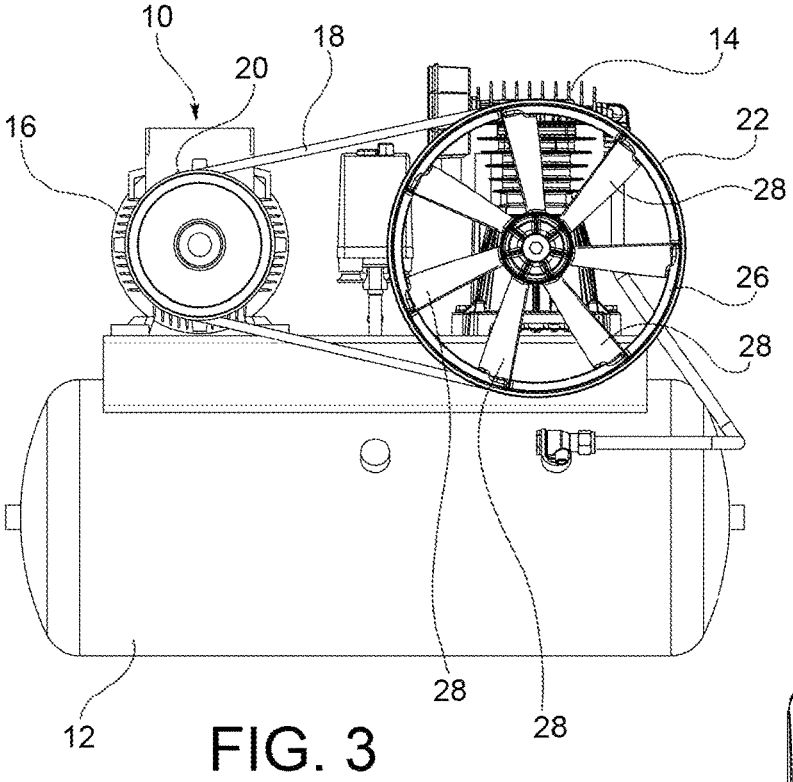
FIG. 3 is a front elevational view of the air compressor of FIGS. 1 and 2, without belt guard.
Figure 4:
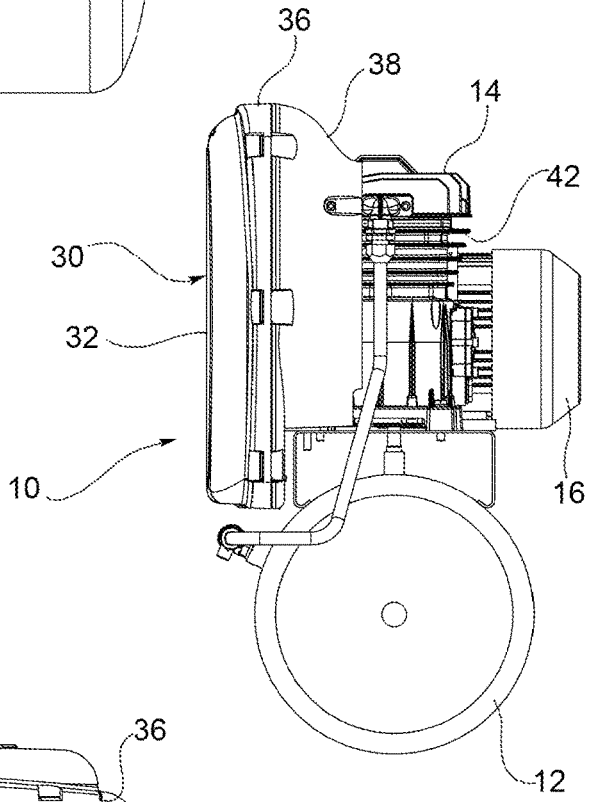
FIGS. 4 and 5 are a side elevational view and a plan view, respectively, of the air compressor of FIGS. 1 and 2.
Figure 5:
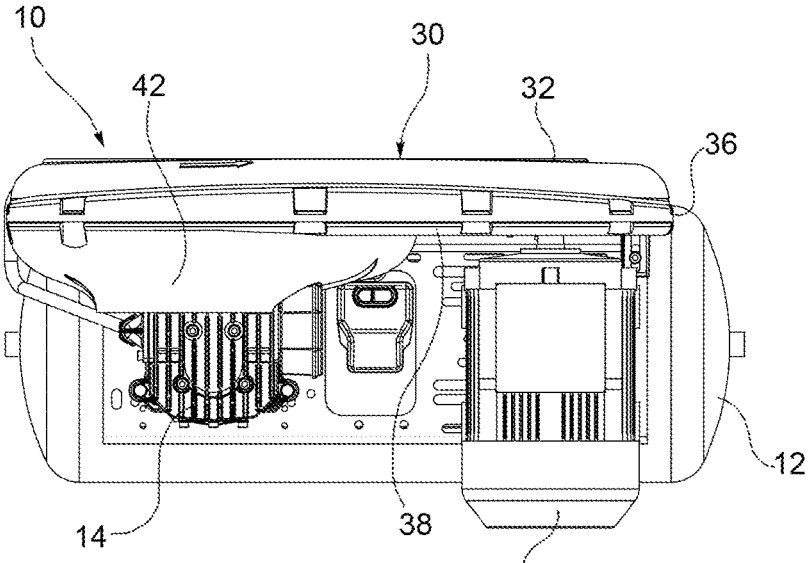
Figure 6:
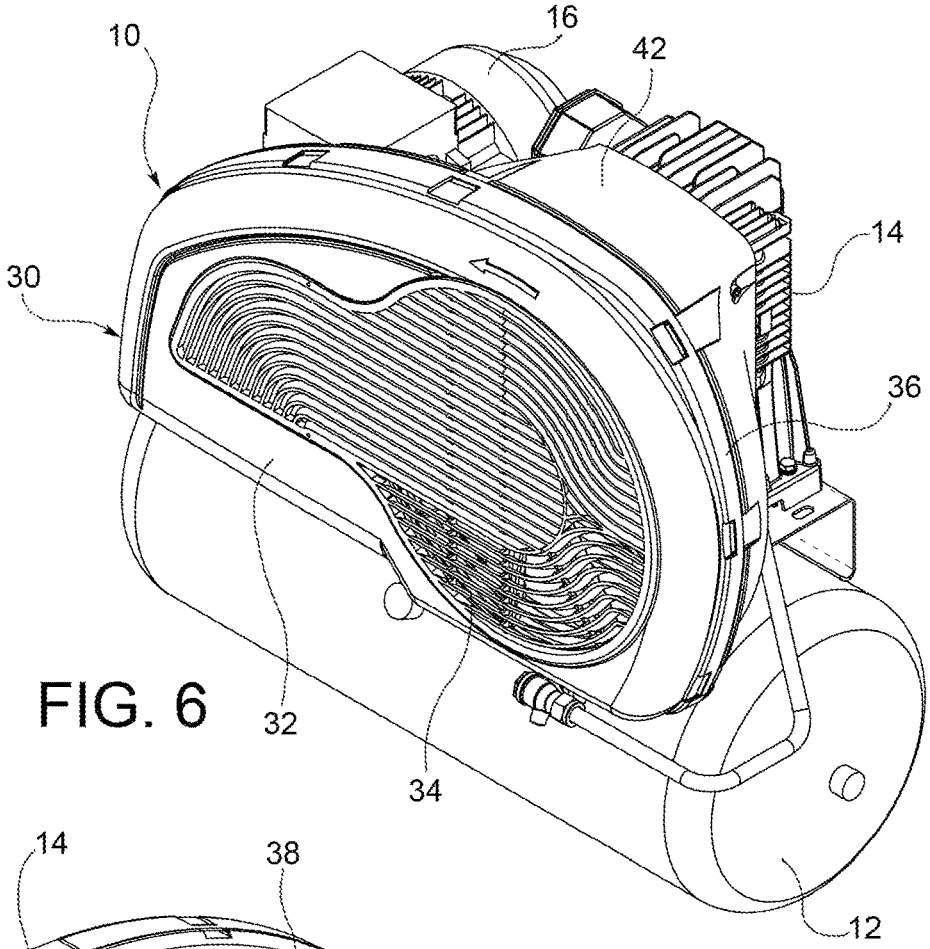
FIGS. 6 and 7 are perspective views, from the front side and from the rear side, respectively, of an air compressor according to another embodiment of the present invention.
Figure 7:
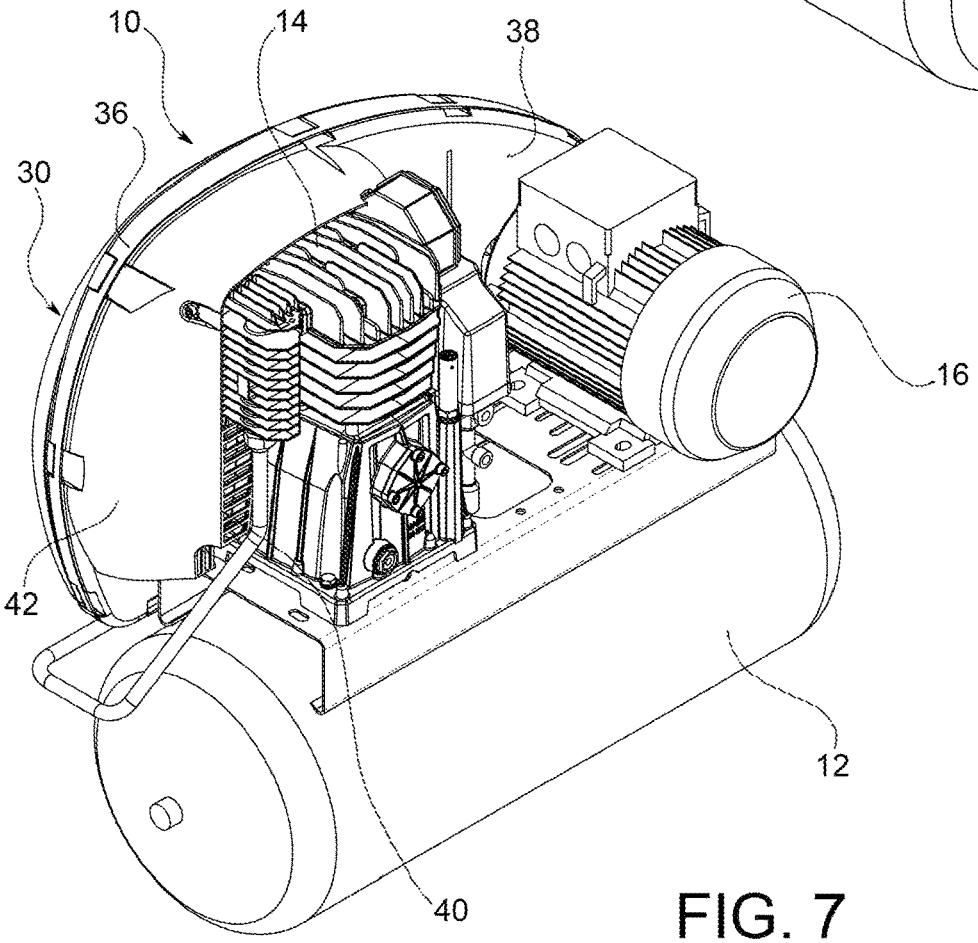
Figure 8:
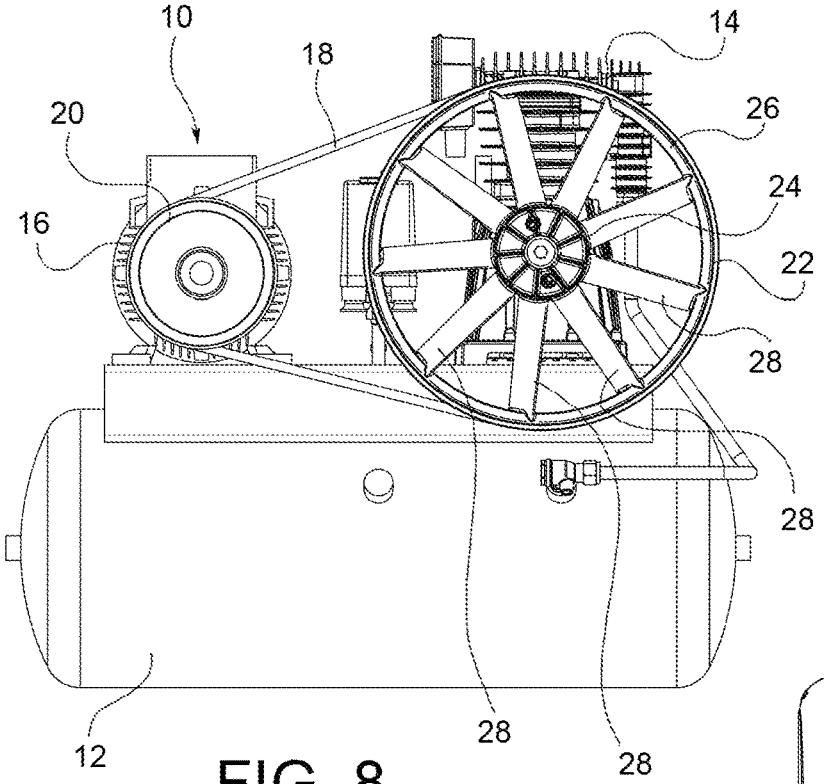
FIG. 8 is a front elevational view of the air compressor of FIGS. 6 and 7, without belt guard.
Figure 9:
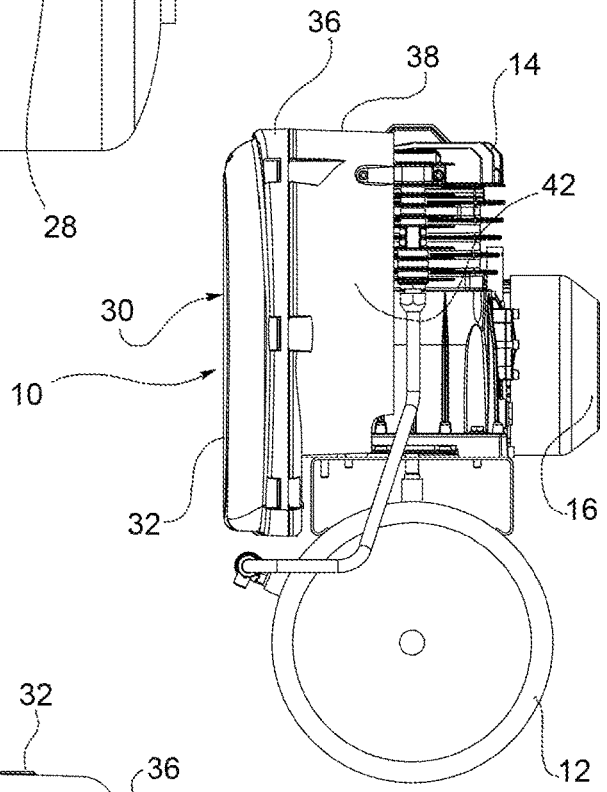
FIGS. 9 and 10 are a side elevational view and a plan view, respectively, of the air compressor of FIGS. 6 and 7.

With reference first to FIGS. 1 to 5, an air compressor according to a preferred embodiment of the present invention is generally indicated 10 and basically comprises a reservoir 12 intended to contain compressed air, a pump unit 14 for producing compressed air to be fed to the reservoir 12, and an electric motor 16 for driving the pump unit 14 by means of a transmission belt 18 (which can only be seen in FIG. 3). The pump unit 14 comprises, in per-se-known manner, a drive shaft (not shown) and the electric motor 16 comprises, in per-se-known manner, a motor shaft (not shown). The drive shaft of the pump unit 14 and the motor shaft of the electric motor 16 are oriented with their respective axes parallel to each other (oriented perpendicular to the plane of the sheet in the front elevational view of FIG. 3). The transmission belt 18 is wound around a driving pulley 20 (which can only be seen in FIG. 3) torsionally coupled to the motor shaft of the electric motor 16 and around a driven pulley 22 (which can only be seen in FIG. 3 either) torsionally coupled to the drive shaft of the pump unit 14. The driven pulley 22 comprises a hub 24 mounted on the drive shaft of the pump unit 14, a ring 26 around which the transmission belt 18 is wound and a plurality of spokes 28 connecting the hub 24 to the ring 26. The driven pulley 22 is made as a fan, the spokes 28 being for this purpose shaped as fan blades, in particular as axial fan blades. The driven pulley 22 thus performs not only the function of transmitting torque to the pump unit 14, but also the function of cooling the pump unit itself.

The air compressor 10 further comprises a belt guard 30 which is made as a cover, in particular of plastic material, and is suitably shaped so as to enclose the transmission belt 18, as well as the driving and driven pulleys 20 and 22. The belt guard 30 includes a substantially flat front wall 32, which extends in a vertical plane, perpendicular to the axes of the shafts of the pump unit 14 and of the electric motor 16, and has a plurality of slits 34 through which air is drawn from the outside by the spokes 28 of the driven pulley 22 made as fan blades. The belt guard 30 further includes a side wall 36 which encloses laterally the space around the transmission belt 18 and around the driving and driven pulleys 20 and 22, and a rear wall 38 which closes on the rear side the space around the transmission belt 18 and around the driving and driven pulleys 20 and 22 and has an opening 40 for receiving the pump unit 14, in such a manner that air drawn from outside through the slits 34 provided in the front wall 32 is wholly conveyed towards the pump unit 14. The rear wall 38 is substantially flat near the electric motor 16, whereas near the pump unit 14, i.e. around the opening 40, it is tapered towards the pump unit 14 and forms a funnel-shaped portion 42 which partially encloses the pump unit 14. The rear wall 38 of the belt guard 30, in particular the funnel-shaped portion 42, covers the pump unit 14 by at least 30% of the depth of the pump unit 14, wherein by depth of the pump unit 14 is meant the size of that unit along the direction of the axis of the respective drive shaft. More specifically, in the embodiment of FIGS. 1 to 5 the amount of covering is preferably higher than 35%, for instance between 35% and 45% approximately. As can be seen in particular in FIGS. 4 and 5, the funnel-shaped portion 42 is suitably shaped so as to convey towards the pump unit 14 the air flow which is drawn through the front wall 32 of the belt guard 30. This, along with the funnel-shaped portion 42 covering the pump unit 14 by at least 30%, allows to significantly increase the capacity of the driven pulley 22, acting as cooling fan, to cool the pump unit 14.

Figure 10:
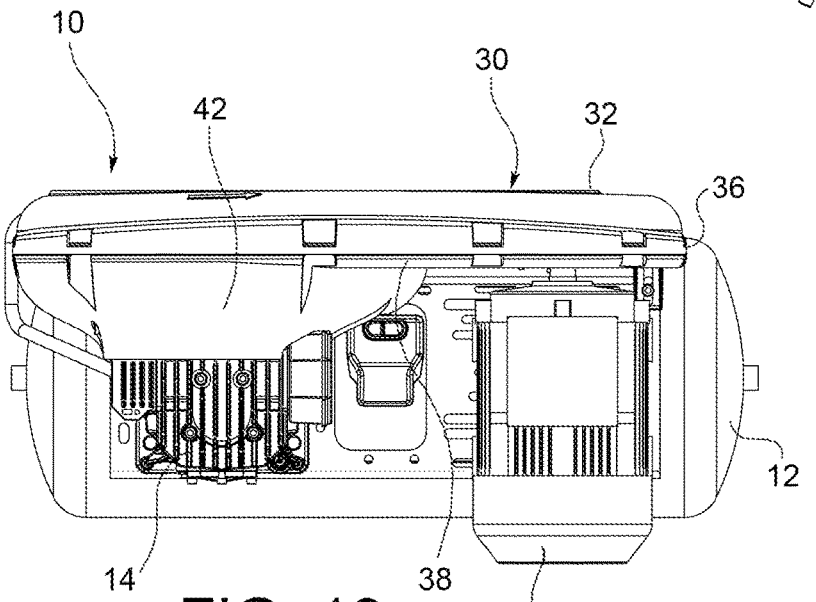

A second embodiment of the air compressor according to the present invention is illustrated in FIGS. 6 to 10, where parts and elements identical or corresponding to those of FIGS. 1 to 5 have been given the same reference numbers. This second embodiment will not be described in detail, since what has already been stated above with reference to the embodiment of FIGS. 1 to 5 fully applies to this second embodiment. The embodiment of FIGS. 6 to 10 differs from that of FIGS. 1 to 5 substantially in the shape of the funnel-shaped portion 42 of the rear wall 38 of the belt guard 30. Whereas in the embodiment of FIGS. 1 to 5 the funnel-shaped portion 42 is tapered both in plan view (FIG. 5) and in side view (FIG. 4), in the embodiment of FIGS. 6 to 10 the funnel-shaped portion 42 is only tapered in plan view (FIG. 10). Also in this case, anyway, the amount of covering is preferably higher than 35%, for instance between 35% and 45% approximately. Also this second embodiment of the invention allows to obtain the same advantages, in terms of higher capacity of cooling the pump unit, as those explained above with reference to the first embodiment.

Naturally, the principle of the invention remaining unchanged, the embodiments and the constructional details may vary widely from those described and illustrated purely by way of non-limiting example, without thereby departing from the scope of the invention as defined in the appended claims.

For instance, even though the air compressor according to both the embodiments described and illustrated in the present application is configured as a portable air compressor, that is to say, as an air compressor provided with wheels to be movable from one place to another, the invention is of course equally applicable also to a stationary air compressor.

The invention claimed is:

1. Air compressor comprising:

a reservoir containing compressed air;

a pump unit for producing the compressed air to be fed to the reservoir;

a motor for driving the pump;

a driving pulley rotating about a first axis, the driving pulley being torsionally coupled to a shaft of the motor;

a driven pulley rotating about a second axis parallel to the first axis, the driven pulley being torsionally coupled to a shaft of the pump to transmit torque from the shaft of the motor to the shaft of the pump, wherein the driven pulley comprises:

a ring, a hub mounted on the shaft of the pump, and spokes connecting the hub to the ring, the spokes being configured as fan blades, wherein the driven pulley transmits torque to the shaft of the pump and cools the pump;

a transmission belt wound around the driving pulley and around the ring of the driven pulley; and a belt guard which encloses the transmission belt, the driving pulley and the driven pulley;

wherein the belt guard is made as a cover and comprises a front wall, in which slits are provided aligned with the driving pulley and the driven pulley for allowing air to be drawn from outside by the spokes of the driven pulley, a side wall which encloses laterally a space around the transmission belt and around the driving pulley and the driven pulley, the side wall being a continuous wall surrounding the transmission belt over an entire length of the transmission belt and having a portion curving around the driven pulley, and a rear wall which closes on a rear side space around the transmission belt and around the driving pulley and the driven pulley and has an opening through which the pump unit extends, and wherein the rear wall of the belt guard forms a funnel-shaped portion that tapers to the opening along a direction parallel to the second axis and partially encloses the pump and is configured to cover the pump by at least 30% of a depth of the pump and less than an entire depth of the pump along a direction aligned with the second axis.

2. Air compressor according to claim 1, wherein the funnel-shaped portion of the rear wall of the belt guard is shaped so as to cover the pump by at least 35% of the depth of the pump.

3. Air compressor according to claim 2, wherein the funnel-shaped portion of the rear wall of the belt guard is shaped so as to cover the pump by 35% to 45% of the depth of the pump.

4. Air compressor according to claim 1, wherein the shaft of the pump extends horizontally and wherein the funnel-shaped portion of the rear wall of the belt guard is tapered toward the opening and the pump unit in a horizontal plane passing through the axis of the shaft of the pump.

5. Air compressor according to claim 4, wherein the funnel-shaped portion of the rear wall of the belt guard is tapered toward the opening and the pump in a vertical plane passing through the axis of the shaft of the pump.

6. Air compressor according to claim 1, wherein the side wall comprises a portion curving around the driving pulley.

7. Air compressor according to claim 1, wherein air drawn from the outside through the slits in the front wall of the belt guard in front of the driving pulley and in front of the driven pulley is conveyed through the funnel-shaped portion and the opening to the pump.

* * * * *